US008648533B2

(12) United States Patent
Kowalczyk et al.

(10) Patent No.: US 8,648,533 B2
(45) Date of Patent: Feb. 11, 2014

(54) OVERMODED CAVITY BOUNDED BY FIRST AND SECOND GRIDS FOR PROVIDING ELECTRON BEAM/RF SIGNAL INTERACTION THAT IS TRANSVERSELY DISTRIBUTED ACROSS THE CAVITY

(75) Inventors: Richard Donald Kowalczyk, San Francisco, CA (US); Mark Frederick Kirshner, Redwood City, CA (US); Craig Bisset Wilsen, Redwood City, CA (US)

(73) Assignee: L-3 Communications Corporation, San Carlos, CA (US)

( * ) Notice: Subject to any disclaimer, the term of this patent is extended or adjusted under 35 U.S.C. 154(b) by 452 days.

(21) Appl. No.: 12/881,009

(22) Filed: Sep. 13, 2010

(65) Prior Publication Data

US 2011/0064414 A1 Mar. 17, 2011

Related U.S. Application Data

(60) Provisional application No. 61/243,010, filed on Sep. 16, 2009.

(51) Int. Cl.
*H01J 23/16* (2006.01)

(52) U.S. Cl.
USPC ..... 315/3.5; 315/5.32; 315/5.37; 315/5.51

(58) Field of Classification Search
USPC ..... 315/5, 5.14, 5.32, 5.33, 5.37, 5.39, 315/5.51, 3.5
See application file for complete search history.

(56) References Cited

U.S. PATENT DOCUMENTS

| | | | | |
|---|---|---|---|---|
| 2,444,749 | A * | 7/1948 | Pearce et al. | 315/5.37 |
| 2,469,843 | A * | 5/1949 | Pierce | 315/5.34 |
| 2,630,546 | A * | 3/1953 | Woodyard et al. | 315/5.19 |
| 2,698,398 | A * | 12/1954 | Ginzton | 315/5.29 |
| 5,469,022 | A | 11/1995 | Begum et al. | |
| 5,932,972 | A * | 8/1999 | Symons | 315/5.16 |
| 2002/0190655 | A1 | 12/2002 | Chen et al. | |
| 2006/0165360 | A1 | 7/2006 | Siegel et al. | |
| 2008/0166095 | A1 | 7/2008 | Popovic et al. | |

* cited by examiner

*Primary Examiner* — Benny Lee
(74) *Attorney, Agent, or Firm* — O'Melveny & Myers LLP

(57) ABSTRACT

An overmoded distributed interaction network is provided that generates high peak and average RF power amplification at high frequencies. A series of overmoded cavities are bounded by parallel or concentric grids that may be separated by metallic spacers adapted to function as a photonic bandgap circuit to suppress competing electromagnetic modes. The selected electromagnetic modes have wavelengths much shorter than the lateral dimension of the grids, allowing the beam-wave interaction to be distributed transversely for improved interaction efficiency. The grids may optionally be slotted and arranged to provide a serpentine traveling wave tube configuration.

17 Claims, 10 Drawing Sheets

OVERMODED CAVITY BOUNDED BY FIRST AND SECOND GRIDS FOR PROVIDING ELECTRON BEAM/RF SIGNAL INTERACTION THAT IS TRANSVERSELY DISTRIBUTED ACROSS THE CAVITY

RELATED APPLICATION DATA

This application claims the benefit under 35 U.S.C. §119 (e) of U.S. Provisional Application No. 61/243,010, filed Sep. 16, 2009.

BACKGROUND OF THE INVENTION

1. Field of the Invention

The present invention relates to circuits for modulating an electron beam or for extracting power from a modulated electron beam. More particularly, it describes a system and method for creating an overmoded distributed interaction network comprising parallel or concentric grids.

2. Description of Related Art

The RF circuit of a microwave vacuum tube amplifier is used to modulate an electron beam and for extracting power from the modulated electron beam. For example, a typical klystron circuit includes a series of re-entrant cavities interacting with a beam propagating through an on-axis beam tunnel, or drift tube. FIG. 1(*a*) depicts a cross section through a klystron output cavity 104. Electron bunches 108 propagate through the drift tube along centerline 116 in the direction indicated at 110 and 112 from an electron source to a collector. The electron beam energy couples to the output cavity 104 at the location indicated by field lines 114. Beam energy may be extracted through a waveguide 106 or other coupling circuit. Another implementation is shown in FIG. 1(*b*). Reference designators in FIG. 1(*b*) that are the same as those in FIG. 1(*a*) refer to corresponding structures. Namely, electron bunches 108 propagate through the drift tube along centerline 116 in the direction indicated at 110 and 112 from an electron source to a collector. The electron beam energy couples to the output cavity 104 at the location indicated by field lines 114. Beam energy may be extracted through a waveguide 106 or other coupling circuit. In FIG. 1(*b*), grids 122 and 124 can be positioned across the drift tube noses of the klystron cavity 104, confining the RF electric field 120 to the gap region and thereby enhancing interaction efficiency. However, the accompanying interception of current by the grids 122 and 124 restricts average power capability. A conventional, doubly re-entrant klystron cavity operating in the fundamental mode is typically about one free-space wavelength in diameter. The beam tunnel and electron beam passing through the center of the cavity along centerline 116, however, are considerably smaller: the former is typically 0.1 to 0.2 wavelengths in diameter. This places a practical limit on the amount of beam current that can be focused through the beam tunnel, which in turn restricts the peak power of the device. Additionally, beam intercept by the RF circuit and, at higher frequencies, ohmic losses limit the average power capability. If the output circuit is configured so that the beam interacts with a higher order mode, an over-sized cavity can be used. While this may allow higher peak and average power operation, the interaction efficiency is substantially reduced. Accordingly, it would be useful to provide a system for extracting electron beam energy that overcomes many of these drawbacks of the prior art.

SUMMARY OF THE INVENTION

In a first aspect of the invention, an overmoded distributed interaction network (ODIN) is configured as at least one overmoded cavity bounded by a first grid and a second grid. The first and second bounding grids each include a plurality of apertures arranged to enable an electron beam to pass through them and into the overmoded cavity. The overmoded cavity is adapted to support an electromagnetic field mode within the cavity. The supported electromagnetic field mode has a wavelength that is smaller than the lateral dimension of the grids such that the interaction of the RF field and the electron beam is distributed transversely throughout the overmoded cavity. The overmoded cavity may optionally include an RF coupling circuit for coupling an RF signal to or from the overmoded cavity.

In certain embodiments of an ODIN in accordance with the invention, the first and second grids are formed as concentric cylinders and configured to interact with a radial electron beam. In such a configuration, the supported electromagnetic field modes will generally have a transverse electromagnetic (TEM) character. In other embodiments, the ODIN comprises parallel planar grids oriented to be substantially perpendicular to the electron beam direction. In some embodiments, the distance between the grids may be maintained by spacers. The spacers may be made from dielectric material or metallic material of from a combination of both. The spacers may be arranged in such a way that a photonic bandgap circuit is formed that acts to attenuate certain electromagnetic modes.

In another aspect of the invention, an ODIN may comprise multiple overmoded cavities formed between a stack of parallel grids, each one of the parallel grids having a plurality of apertures to allow passage of the electron beam and a plurality of spacers to maintain a selected distance between adjacent grids. The spacing between adjacent grids need not be uniform. Such a stack of adjacent overmoded cavities may be configured to operate as a coupled-cavity travelling wave tube. An input waveguide may be coupled to a cavity at one end of the stack, and an output waveguide may be coupled to a cavity at the other end of the stack.

In another aspect of the invention, the parallel grids formed into a stack may further each include a coupling slot to facilitate coupling of the electromagnetic field between adjacent overmoded cavities. In one embodiment, the slots in adjacent parallel grids may be on opposite sides of the grid such that a serpentine path for the electromagnetic field through the stack is formed. Alternatively, the slots may be aligned with one another or placed in any other desired orientation with respect to one another.

In some aspects of the invention, the incident electron beam may be divided into beamlets, wherein each beamlet is directed through a corresponding one of the plurality of apertures in the grid plates. This has the advantage of reducing beam loss due to impingement on the grid surfaces. In addition, the electron beamlets can be directed toward certain selected apertures in the grid plates that are near locations where a desired electromagnetic field mode would have peak field intensities. In this way, the selective direction of the electron beamlets can be used to excite specific desired electromagnetic modes. Further, the electron beam or beamlets may be bunched before entering the overmoded cavities, which may provide certain advantages for RF amplification.

Certain other aspects and applications of the invention will be clear to those skilled in the art and would similarly fall within the scope and spirit of the present invention. The preferred embodiments will be described in detail below with reference to the attached sheets of drawings, which will first be described briefly.

DETAILED DESCRIPTION OF THE PREFERRED EMBODIMENT

The overmoded distributed interaction network (ODIN) of the present invention addresses the need for high peak and average RF power amplification at high frequencies. An embodiment of the circuit comprises a series of overmoded cavities bounded by parallel or concentric grids that may be separated by an array of metallic or dielectric spacers. The wavelength of the mode supported between the grids is much smaller than the lateral dimensions of the gridded cavity, allowing the beam-wave interaction to be distributed transversely. The resulting improvement in power handling capability is of particular benefit to higher frequency devices. The spacers facilitate fabrication and may be configured as a photonic bandgap circuit for suppressing mode competition. In one embodiment, a cavity is formed between two parallel grids. In another embodiment, a coaxial cavity operates in a TEM-like mode for interaction with a radially directed beam. A series of grids can be arranged sequentially to form an extended interaction circuit, similar to those used in extended interaction klystrons. Alternatively, the overmoded cavities can be stacked and coupled together with the proper matched RF impedance at the first and last cavity, to form a network that will support a traveling wave mode.

Figure 1A:
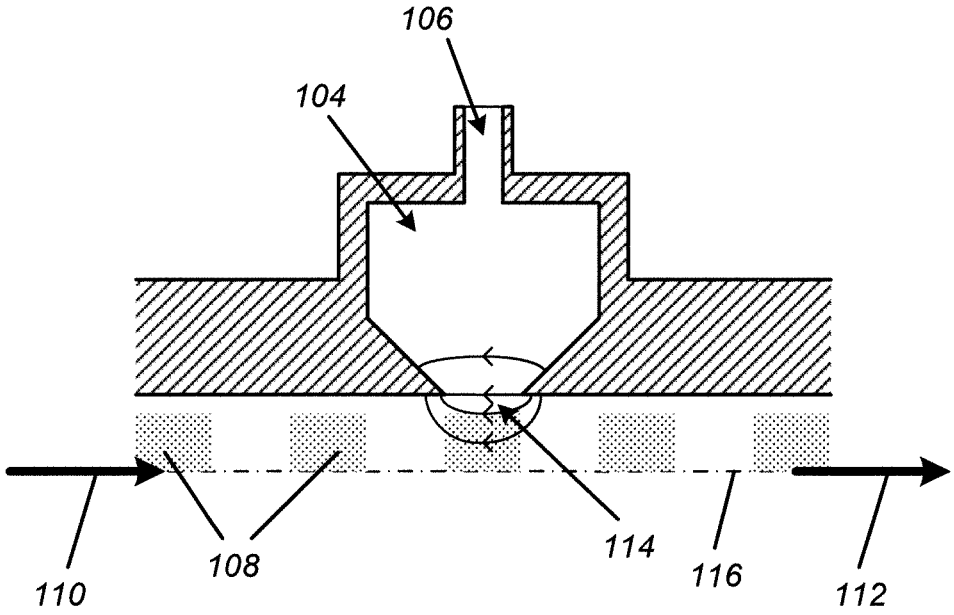
Fig. 1(a) (Prior Art)
FIGS. 1(*a*) and 1(*b*) depict cross sections of klystron output cavities typical of the prior art.
Figure 1B:
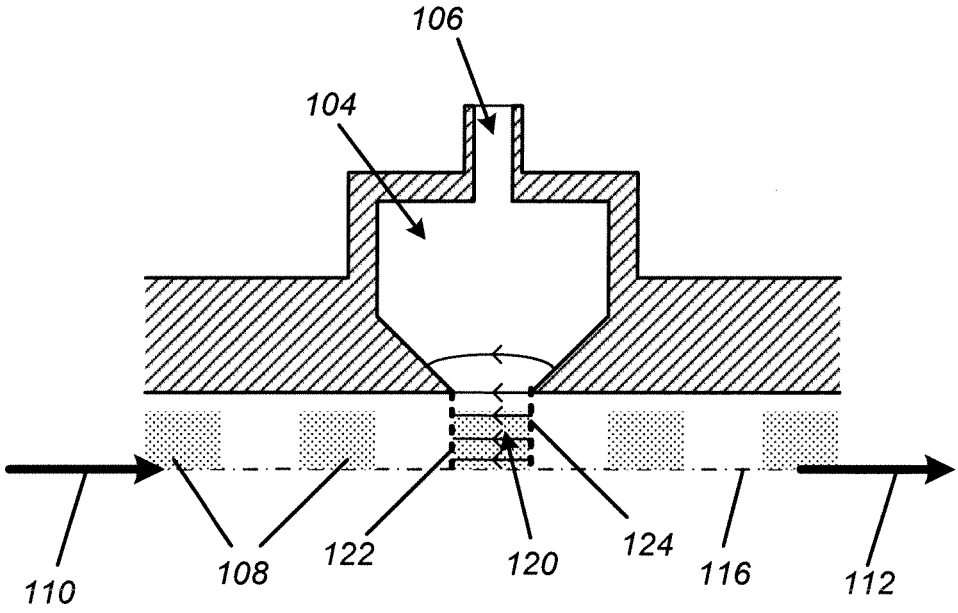
Fig. 1(b) (Prior Art)
Figure 2:
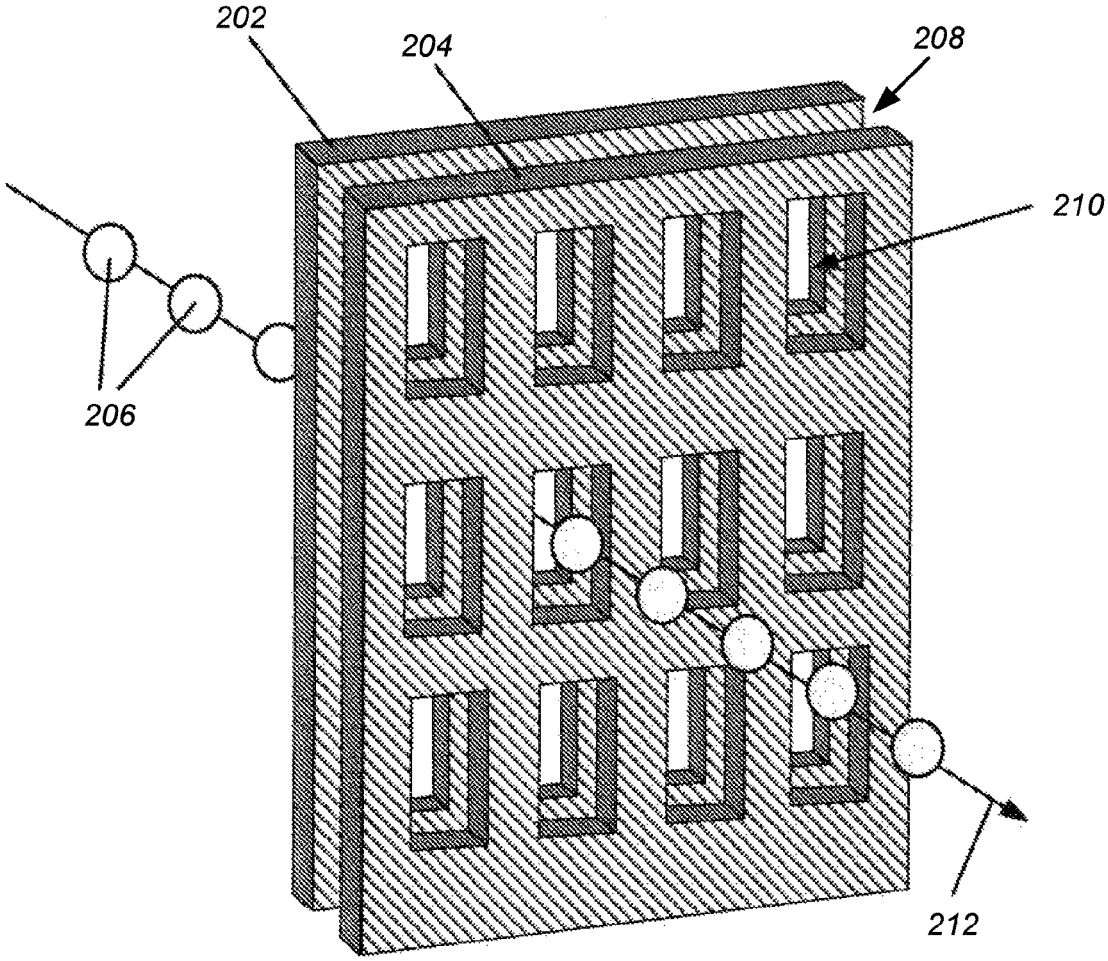
FIG. 2 is a perspective drawing of an embodiment of an overmoded distributed interaction network (ODIN) in accordance with the present invention.

FIG. 2 illustrates a preferred embodiment of an ODIN in accordance with the present invention. An RF cavity is formed by creating a gap 208 between a first grid 202 and a second grid 204 placed parallel to the first grid 202. An electron beam is separated into a number of beamlets, each focused through an aperture 210 in the grids. One such beamlet is illustrated at 212 and comprises a series of electron bunches 206 that propagate through the two parallel grids 202 and 204. The ODIN functions similarly to the cavity of a conventional klystron. As the electron beamlets 212 pass through the gap 208 between the grids 202 and 204, they induce RF currents in the cavity, exciting one or more resonant modes. When the cavity is coupled to an external load, this interaction will extract microwave power from the beam. The dimensions of the cavity 208 transverse to the direction of beam propagation 212 determine the resonant frequency. As in other more conventional cavities, the interaction gap length 208 (i.e., the distance between the grids) is governed by the transit angle, which is preferably on the order of one radian for efficient interaction. For operation at 20 kV and 100 GHz, for example, this translates into a gap length 208 of approximately 0.005 inch.

Figure 3:
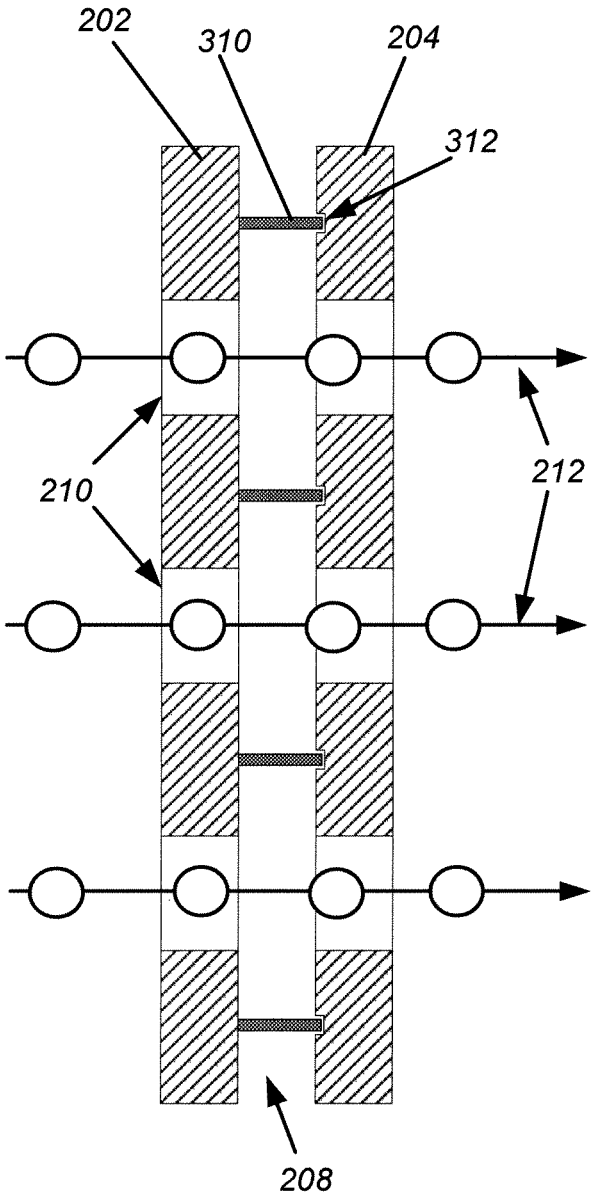
FIG. 3 is an edge-on view of the embodiment of the ODIN depicted in FIG. 2.

FIG. 3 is an edge-on view of the embodiment of the ODIN shown in FIG. 2. An RF cavity is formed by creating a gap 208 between grids 202 and 204. Electron beamlets 212 are directed through openings 210 in grid 202. FIG. 3 illustrates that metallic or dielectric posts 310 can be introduced between grids 202 and 204 to maintain the grid spacing. A convenient method of manufacture leaves posts 310 machined on the first grid 202, upon which the second grid 204 rests. As shown at 312, a notch in second grid 204 may accept a post 310 in order to index the second grid 204 with respect to the first grid 202.

Figure 4:
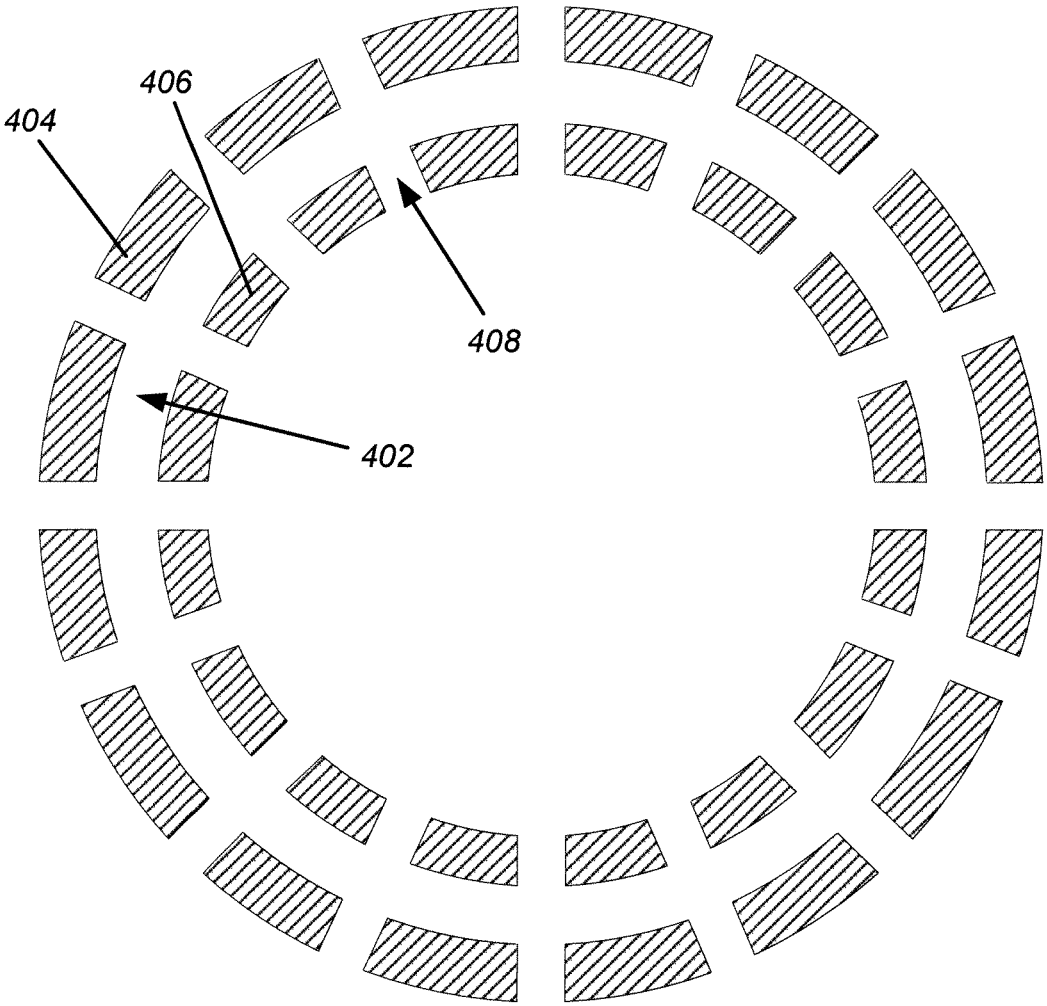
FIG. 4 a cross section of an alternative embodiment of an ODIN in accordance with the present invention that has a coaxial grid structure.

FIG. 4 illustrates another embodiment of an ODIN in accordance with the present invention that utilizes a coaxial rather than a planar geometry. In this case, an inner grid 406 is separated from an outer grid 404 to create a gap 402. As electron bunches propagate through apertures, e.g., 408, in the grid structure, they induce RF currents in the gap 402, exciting one or more resonant modes from which energy can be extracted. Additional planar, coaxial, and other geometries are feasible.

Figure 5:
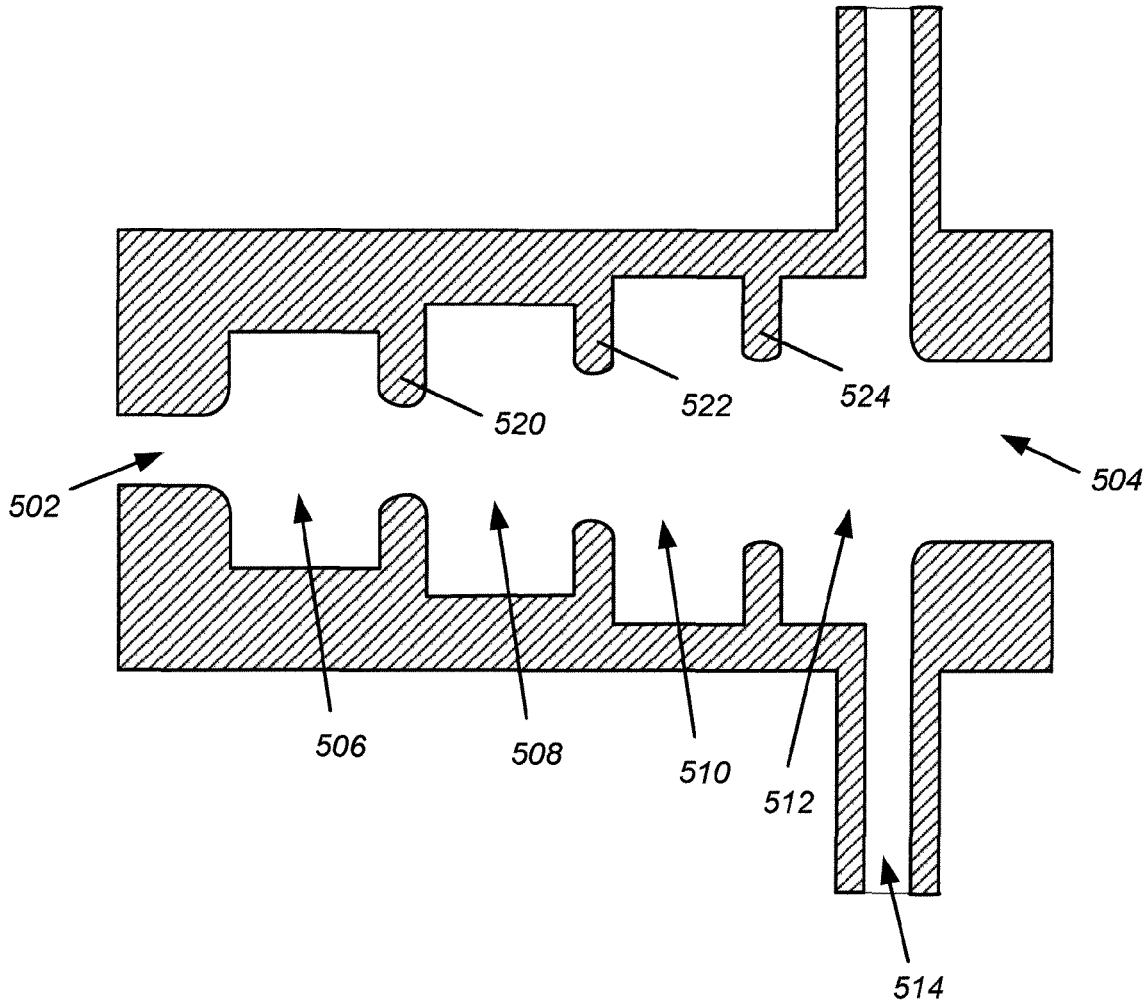
Fig. 5 (Prior Art)
FIG. 5 is a cross section of an extended interaction output circuit known in the prior art.

A method known in the prior art of increasing the efficiency and/or bandwidth of an output circuit is to couple a series of fundamental-mode cavities together to form an extended interaction output circuit (EIOC). FIG. 5 illustrates a cross section one such structure, as described by Begum and Symons in U.S. Pat. No. 5,469,022. The EIOC includes an entrance tunnel 502 into which an electron beam is introduced. The EIOC includes multiple annular structures 520, 522, and 524 that divide the interior into multiple resonant cavities 506, 508, 510 and 512, with which the electron beam interacts before exiting through the output tunnel 504. Energy is extracted from the cavities through waveguide port 514.

Figure 6:
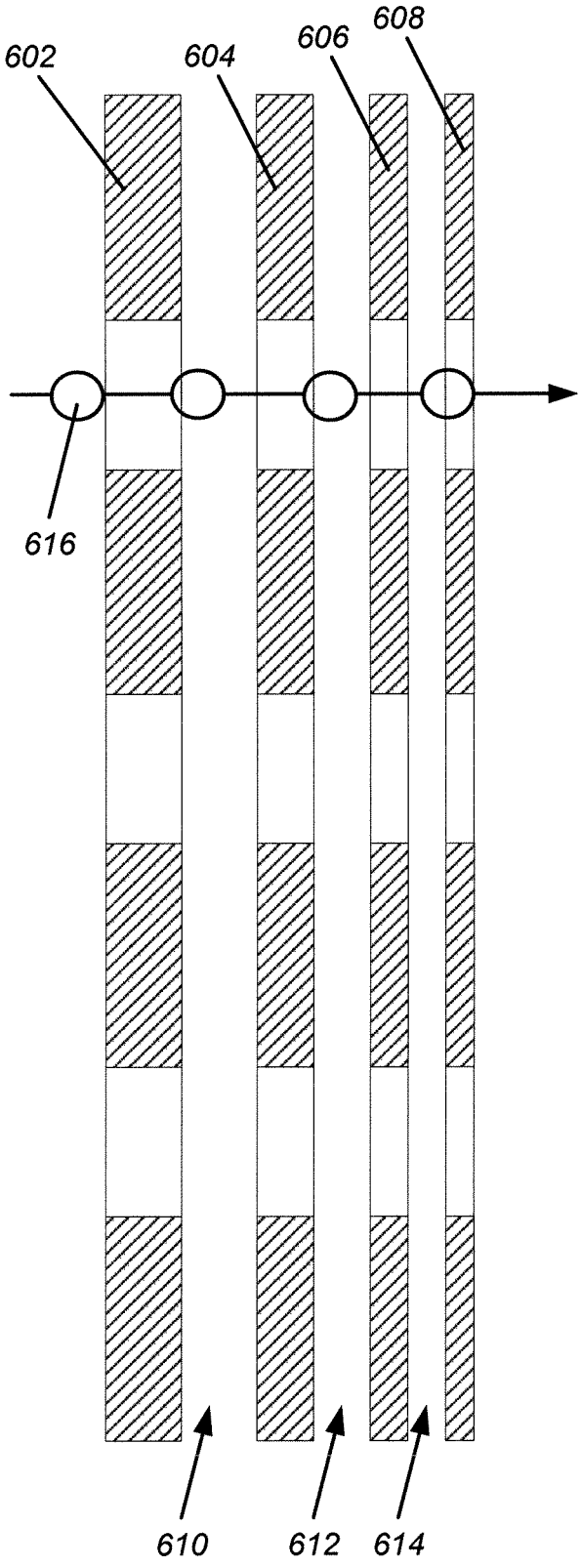
FIG. 6 is an alternative embodiment of an overmoded distributed interaction network (ODIN) in accordance with the present invention.

An alternative embodiment of an ODIN in accordance with the present invention uses multiple layers of grids to provide a sequence of cavities similar to an EIOC, thereby increasing the interaction efficiency. FIG. 6 is a cross section of an exemplary embodiment of such an ODIN that uses four grids 602, 604, 606, and 608 to create three interaction gaps 610, 612, and 614. The thickness of the grids sets the spacing of the multiple interaction gaps. When the grid thickness is chosen as an integer multiple of the distance traveled by the electron bunches 616 in one RF cycle, all gaps are excited in phase; other arrangements are feasible. Although the embodiment shown includes four grids, embodiments with other numbers of grids are possible and would also fall within the scope and spirit of the present invention. The multiple grids forming the overmoded distributed interaction circuit are typically at ground potential, allowing the RF output power to be transmitted without the need for a DC block. The spent beam exiting the ODIN is captured by a collector. The collector is a physically separate element, allowing it to be set at a potential below that of the output circuit for recovery of unused beam energy.

In the preceding embodiments, the bandwidth of the ODIN can be controlled by the external Q, the degree of output coupling, or by changing the tuning of each cavity in the multilayer configuration. For high gain, each cavity is set to the same frequency (synchronous tuning), while for increased bandwidth, the cavity frequencies are offset.

Figure 7:
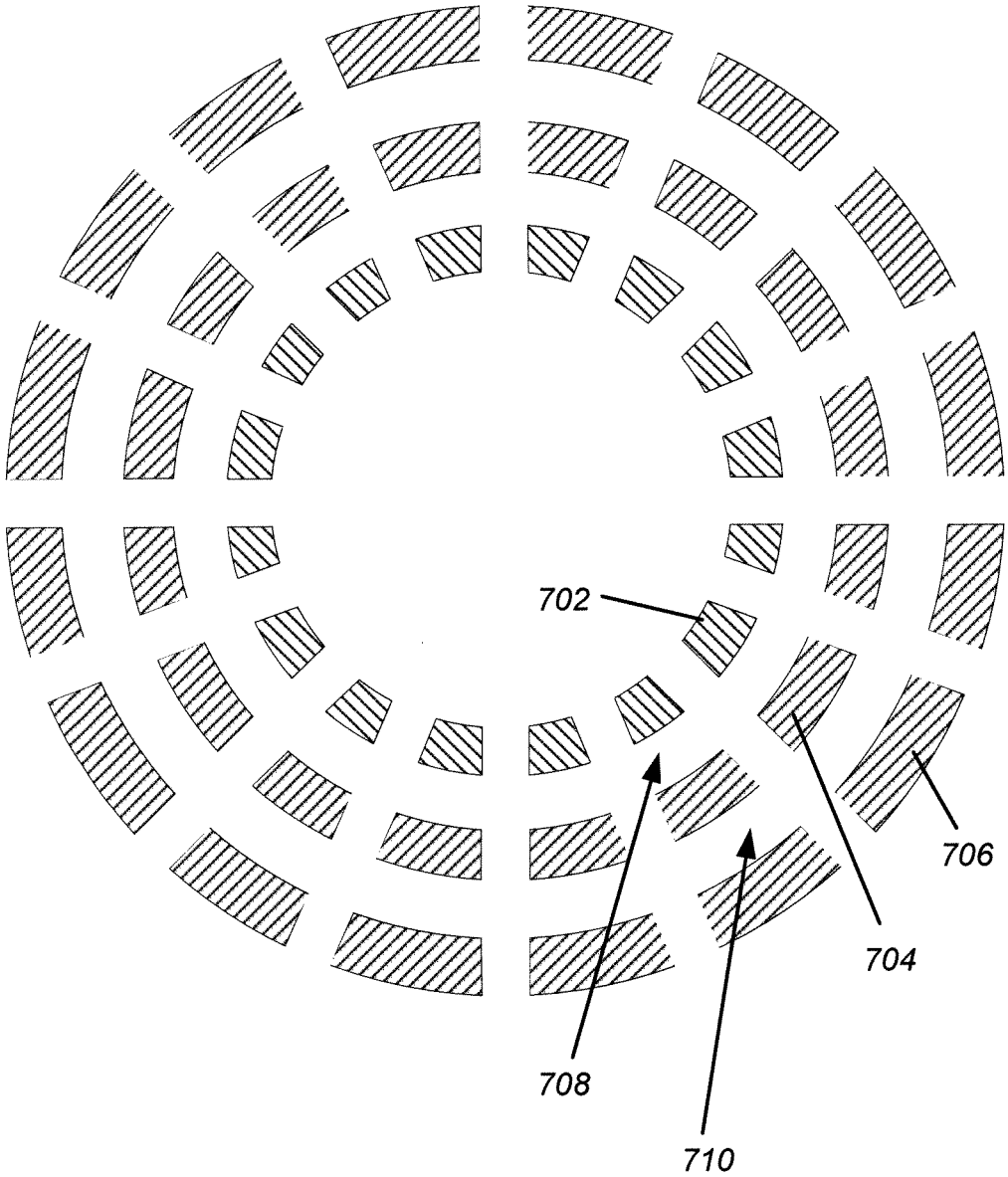
FIG. 7 is yet another alternative embodiment of an overmoded distributed interaction network (ODIN) in accordance with the present invention.

An alternative embodiment of an ODIN is shown schematically in FIG. 7. Here, a coaxial ODIN is presented having a multiple coaxial grid structure. In the embodiment shown, an inner grid 702, a middle grid 704 and an outer grid 706 form two interaction gaps 708 and 710. Of course, other numbers of grids are possible and such embodiments would also fall within the scope and spirit of the present invention.

A coaxial structure such as the one depicted in FIG. 7 can be operated in a TEM-like mode, allowing the diameter to be varied without changing the mode pattern and frequency, which are fixed by cavity height and the spacer distribution (not shown in FIG. 7). This allows the output circuit diameter to satisfy other design constraints, such as voltage stand-off. However, a larger diameter increases the stored energy, reducing the shunt impedance and hence the energy extraction efficiency. As a result, a modest increase in current may be required to attain the same power levels as the circuit diameter grows. The power extracted from the cavities is coupled in parallel to a common coaxial transmission line.

Figure 8:
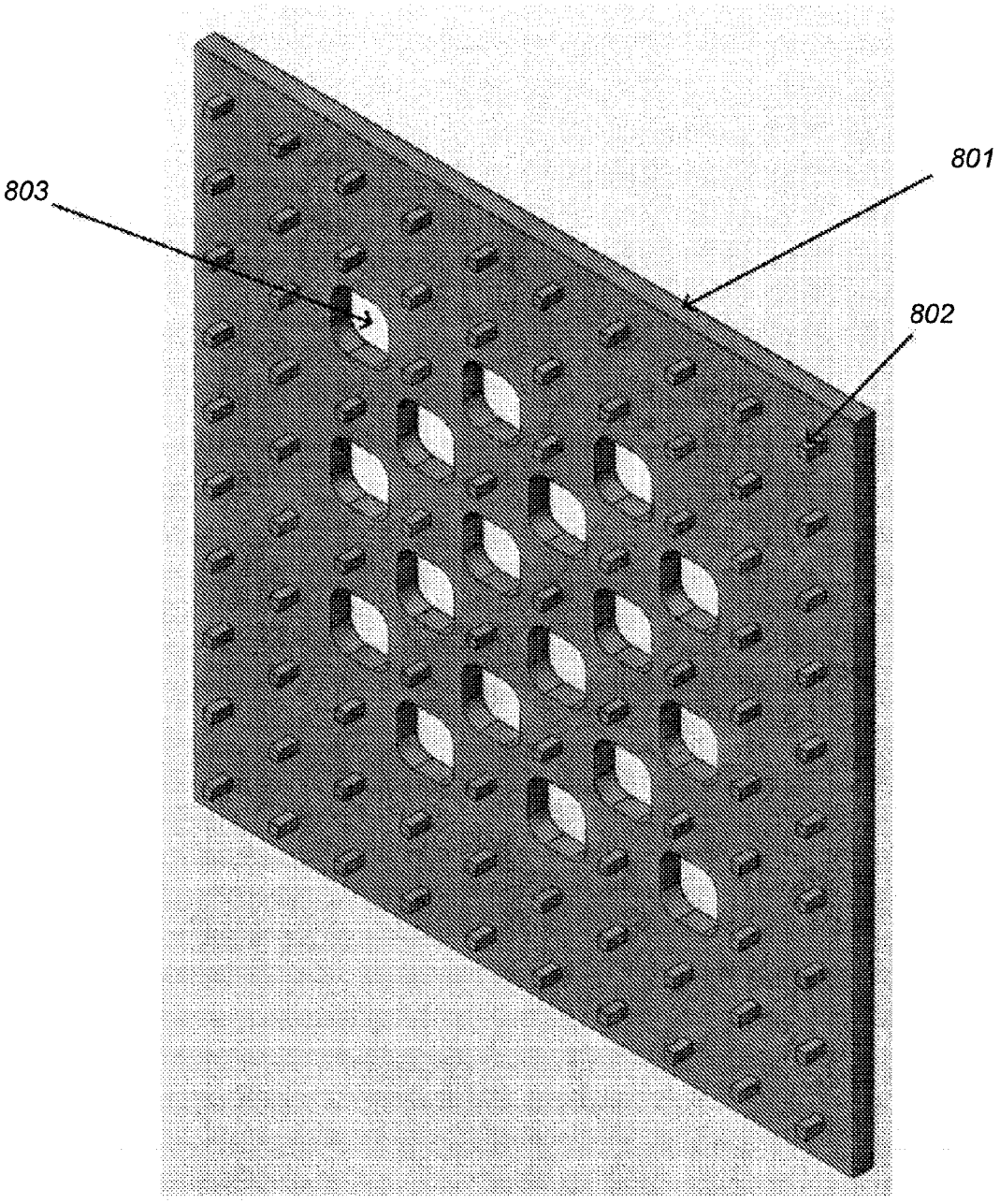
FIG. 8 is a perspective drawing of a single element of an overmoded distributed interaction network (ODIN) in accordance with the present invention.

A single, stackable element for a planar embodiment of an ODIN is shown in FIG. 8. It consists of a grid 801, multiple spacers 802 and multiple apertures 803.

Figure 9:
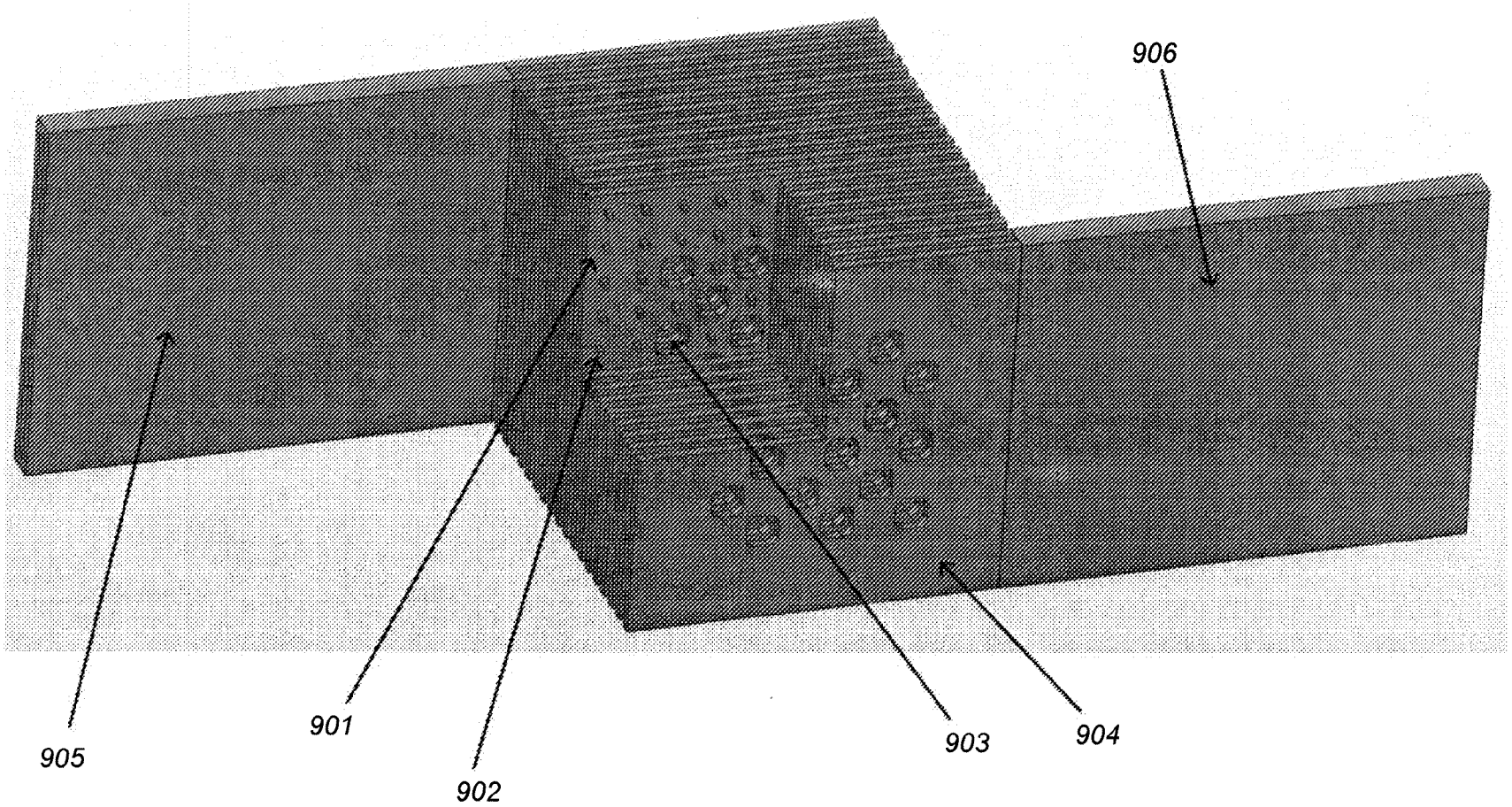
FIG. 9 is a perspective drawing of an embodiment of an overmoded distributed interaction network (ODIN) configured as a coupled cavity traveling wave tube in accordance with the present invention.

An embodiment of an overmoded distributed interaction network (ODIN) configured as a traveling wave tube (TWT) is shown in FIG. 9. This structure is assembled by stacking a series of the elements introduced in FIG. 8. A component of the stack of elements includes grid 901, spacer 902 and aperture 903 in grid 901. To the stack is added an end plate 904, an input waveguide 905 and an output waveguide 906. This amplifier functions as a conventional coupled cavity TWT, though it is overmoded and has coupling through the grid apertures. A DC electron beam is modulated by interaction with the structure in response to the input signal; subsequent interaction between the modulated beam and the circuit causes the circuit wave to be amplified. Design details such as an electron gun, a magnetic focusing circuit, a sever and a collector for the spent beam are not shown.

Figure 10:
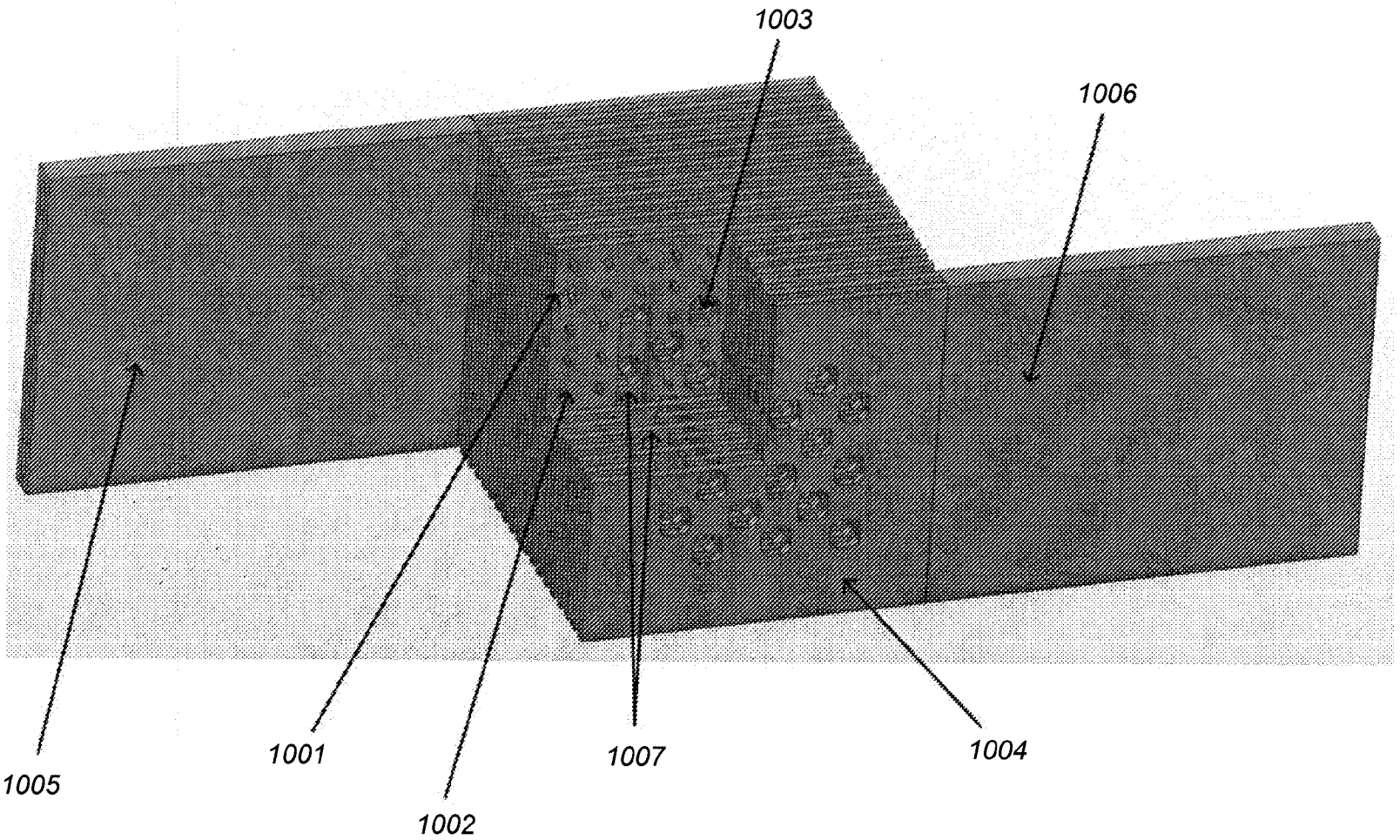
FIG. 10 is a perspective drawing of an embodiment of an overmoded distributed interaction network (ODIN) configured as a serpentine traveling wave tube in accordance with the present invention.

An embodiment of an overmoded distributed interaction network (ODIN) configured as a serpentine traveling wave tube is shown in FIG. 10. This structure is assembled by stacking a series of the elements introduced in FIG. 8, suitably modified with coupling slots. A component of the stack of elements includes grid 1001, spacer 1002 and aperture 1003 in grid 1001. To the stack is added an end plate 1004, an input waveguide 1005, and an output waveguide 1006. In grid 1001 is a series of coupling slots 1007. This amplifier functions as a serpentine coupled cavity TWT, though the cavities are overmoded. Coupling between cavities occurs through staggered slots located on opposite sides of each successive grid. This is equivalent to a 180° slot rotation angle, causing the electromagnetic wave to follow a serpentine path from the input to the output. The coupling slots need not be aligned with the grid apertures. Again, design details such as an electron gun, a magnetic focusing circuit, a sever and a collector for the spent beam are not shown. Slot rotation angles other than 180° are possible. For example in-line slots have a rotation angle of 0°; other angles may be chosen to achieve the desired dispersion characteristic.

Other vacuum tube amplifiers that may be configured to utilize an ODIN include multi-beam klystrons and extended interaction klystrons. For the latter, the ODIN may support a standing wave or traveling wave. Furthermore, the coaxially configured ODIN allows implementation of radial amplifiers, in which the electron beamlets propagate radially inwards or outwards. Note that whereas amplifiers are mentioned above, oscillators using the ODIN likewise fall within the scope of the invention.

The large physical size of the ODIN, in accordance with the multiple embodiments presented herein, allows distribution of the thermal loading, enabling higher average power operation. Additionally, focusing of the beamlets through the grid apertures provides a means of eliminating the limitation imposed on average power by grid interception. As with any overmoded circuit, preventing the excitation of unwanted modes close to the operating frequency may be necessary. To accomplish this, the array of metallic spacers can be designed to form a 2D photonic band gap (PBG) structure. By appropriately choosing the dimensions of the spacers, and the lateral distance between them, only electromagnetic fields within certain frequency ranges (the "bandgaps" of the array) are confined. Any mode or resonance outside of these bands will propagate outward. Materials such as lossy dielectrics or high resistivity electrical conductors can be located around the perimeter of the circuit to attenuate the unwanted modes.

The size, shape and configuration of the spacers determine the bandgaps. A simple example is provided in FIG. 5*a* of E. I. Smirnova, C. Chen, M. A. Shapiro, J. R. Sirigiri, and R. J. Temkin, *Simulation of Photonic Ban Gaps in Metal Rod Lattices for Microwave Applications*, J. Appl. Phys. 91, 960 (2002). That figure shows the confined frequency bands as a function of the ratio of diameter (2a) to center-to-center distance (b), for round spacers. In this case, it can be seen that a choice of a/b of slightly over 0.1 will provide two confined bands—one a low frequency band, and the other a narrow, higher frequency band. Operating in the high frequency band would prevent oscillations or other parasitic phenomena above the operating frequencies. It should be noted that this example is valid for round spacers, with a single missing spacer in an infinite array. The exact choice of ODIN dimensions required for mode control will depend upon the number, location and shape of the spacers. In a coaxial embodiment, this 2D photonic bandgap structure would be wrapped into a cylinder.

There are additional opportunities for mode control. One technique is to preferentially excite the desired operating mode by propagating beamlets of electrons through the apertures corresponding to peaks in the field pattern. This approach becomes more effective if an emission-gated electron gun is used so that the electron beamlets are pre-bunched. Alternatively, for those cavities not coupled to an external load (i.e. not at the input, output or sever) cavity walls can be introduced to form fundamental mode cells around each aperture.

In conclusion, the overmoded distributed interaction network provides a novel method for beam-wave interaction in high average power, high frequency vacuum tube amplifiers, with application in the terahertz regime.

What is claimed is:

1. An overmoded distributed interaction network (ODIN) configured to support an interaction between an electron beam and a radio frequency (RF) signal, wherein the ODIN comprises:

an overmoded cavity bounded by a first grid and a second grid, wherein the first grid and the second grid each includes a plurality of apertures arranged to enable the electron beam to pass through the overmoded cavity along a beam direction from the first grid to the second grid; wherein:

the overmoded cavity is oriented transverse to the beam direction;

the first grid and the second grid are separated by a distance of the order of one radian of electron beam transit angle;

the overmoded cavity is adapted such that at least one electromagnetic field mode is supported within the overmoded cavity, the supported electromagnetic field mode having a wavelength smaller than a dimension of the first grid measured along a direction substantially perpendicular to the beam direction; and wherein the interaction between the electron beam and the RF signal is distributed within the overmoded cavity transverse to the beam direction.

2. The ODIN of claim 1, further adapted to include an RF coupling circuit operatively connected to the overmoded cavity to couple the RF signal to or from the overmoded cavity.

3. The ODIN of claim 1, wherein the first grid and the second grid each comprise concentric cylinders and the beam direction is substantially radial.

4. The ODIN of claim 3, wherein the at least one supported electromagnetic field mode has a transverse electromagnetic mode (TEM) characteristic.

5. The ODIN of claim 1, wherein the first grid and the second grid each comprise parallel planar grids positioned substantially perpendicular to the beam direction.

6. The ODIN of claim 1, wherein a distance between the first grid and the second grid is maintained by a plurality of spacers.

7. The ODIN of claim 6, wherein the plurality of spacers is formed from a material selected to be one of a metallic material and a dielectric material.

8. The ODIN of claim 6, wherein the plurality of spacers is arranged to form a photonic bandgap circuit operative to attenuate one or more electromagnetic field modes within the overmoded cavity.

9. The ODIN of claim 1, comprising additional transversely overmoded cavities formed by stacking additional grids parallel to the first grid and the second grid, each one of the additional grids comprising:

a plurality of apertures arranged to allow passage of the electron beam; and a plurality of spacers arranged to maintain a selected distance to an adjacent grid.

10. The ODIN of claim 9, configured to operate as a coupled-cavity traveling wave tube and including an RF coupling circuit comprising:

an input waveguide coupled to at least one of the transversely overmoded cavities; and an output waveguide coupled to at least one of the overmoded cavities which is not coupled to the input waveguide.

11. The ODIN of claim 10, wherein each of the parallel grids is further adapted to include a coupling slot such that each of the transversely overmoded cavities is electromagnetically coupled to an adjacent transversely overmoded cavity via the respective coupling slot.

12. The ODIN of claim 11, wherein the coupling slots in adjacent parallel grids are arranged in a staggered configuration such that an electromagnetic wave follows a serpentine path between the input waveguide and the output waveguide.

13. In an overmoded distributed interaction network (ODIN) comprising at least a first grid and a second grid each having a plurality of apertures and bounding an overmoded cavity, a method of creating a spatially distributed interaction between an electron beam and a radio frequency (RF) signal comprises the steps of:

locating the first and second grids such that they are separated by a distance of the order of one radian of electron beam transit angle;

injecting the electron beam into the overmoded cavity in a beam direction through the plurality of apertures from the first grid to the second grid, wherein the overmoded cavity is oriented in a direction transverse to the beam direction; and exciting the RF signal in the transversely overmoded cavity such that an electromagnetic field mode is supported that has a wavelength shorter than a dimension of the first grid measured in a direction substantially perpendicular to the beam direction.

14. The method of claim 13, further comprising the step of dividing the electron beam into a set of electron beamlets, each beamlet arranged to align with a corresponding one of the plurality of apertures, such that electron beam impingement on the first grid and second grid is reduced.

15. The method of claim 13, further comprising the step of bunching the electron beam before entering the overmoded cavity.

16. The method of claim 14, wherein the step of dividing the electron beam into a set of electron beamlets further includes enhancing one or more electromagnetic modes by selectively directing the electron beamlets through certain ones of the plurality of apertures located in regions where the one or more electromagnetic modes have peak field intensities.

17. The method of claim 13, wherein the step of coupling the RF signal into the overmoded cavity further includes the step of rejecting selected electromagnetic modes by positioning spacers between the first grid and second grid to form a photonic bandgap circuit within the overmoded cavity to attenuate the selected electromagnetic modes.

* * * * *